United States Patent [19]

Green

[11] Patent Number: 4,653,751

[45] Date of Patent: Mar. 31, 1987

[54] HEAVY DUTY MULTI-FUNCTION EXERCISE BENCH

[76] Inventor: Douglas P. Green, 2016 Yorktown Ct. South, League City, Tex. 77573

[21] Appl. No.: 709,594

[22] Filed: Mar. 8, 1985

[51] Int. Cl.[4] ..... A63B 23/00

[52] U.S. Cl. ..... 272/144; 272/123

[58] Field of Search ..... 272/144, 145, 134, 93, 272/117, 118, 123; 128/74; 5/62, 66, 68, 69; 269/323, 324, 325

[56] References Cited

U.S. PATENT DOCUMENTS

| | | | |
|---|---|---|---|
| 4,098,502 | 7/1978 | Faust | 272/144 |
| 4,231,570 | 11/1980 | Reis | 272/123 |
| 4,353,547 | 10/1982 | Jenkinson | 272/134 X |
| 4,407,495 | 10/1983 | Wilson | 272/117 |
| 4,509,746 | 4/1985 | Mask | 272/134 |
| 4,546,967 | 10/1985 | Kecala | 272/93 |

*Primary Examiner*—Richard J. Apley
*Assistant Examiner*—John Welsh
*Attorney, Agent, or Firm*—William D. Zahrt, II

[57] ABSTRACT

An extremely versatile heavy duty exercise bench (10) integrates the functional features necessary for body development through weight lifting, by providing a manually operable, double adjustable, reversible, tiltable, and sliding seat configuration (15, 20). The seat mounting means (15) includes upwardly facing rails (32) which face complementary flanges (33) on a flange assembly (34) on the bottom of the seat (20). The flanges (33) ride upon the rails (32) and guide longitudinal movement of the seat (20), while leaving the seat (20) free to be lifted manually and reversed. A manually operable clamp (60) secures the seat (20) in position on the mounting means (15) when the seat (20) is in use. Hinges (36,37) and telescoping tubes (41,42) provide for independent adjustment of the tilting of the seat portions (21,22). The bench (10) also includes a dual foam seat construction (27,28), efficient and manually operable angled locking pins (50) for adjusting certain bench-/seat positions, manually operable clamp means (60) for adjusting other bench/seat positions, and a combined spotter-tipover stand (80) for improved bench stability.

15 Claims, 17 Drawing Figures

FIG.1
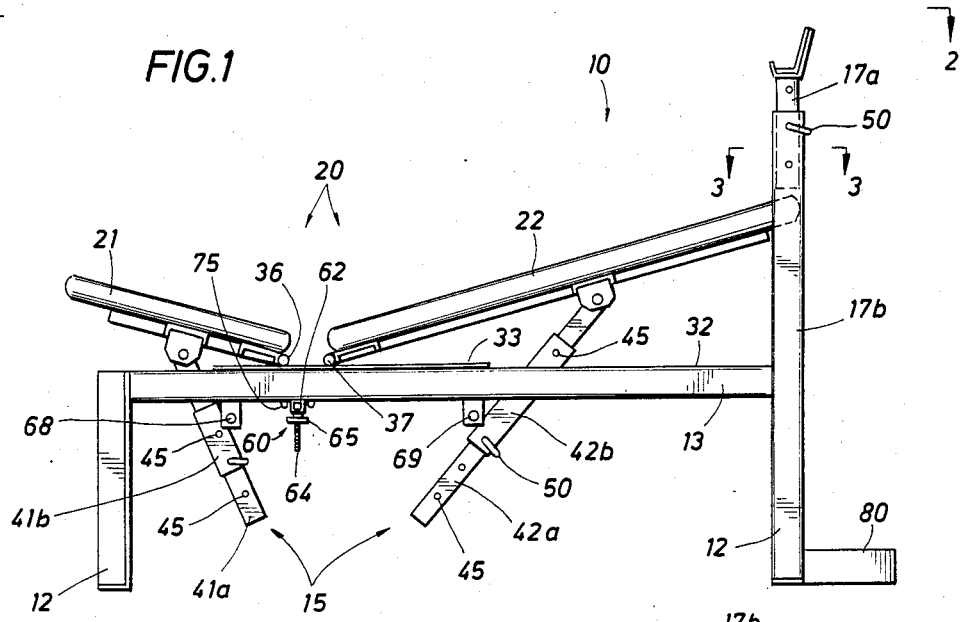
FIG. 2
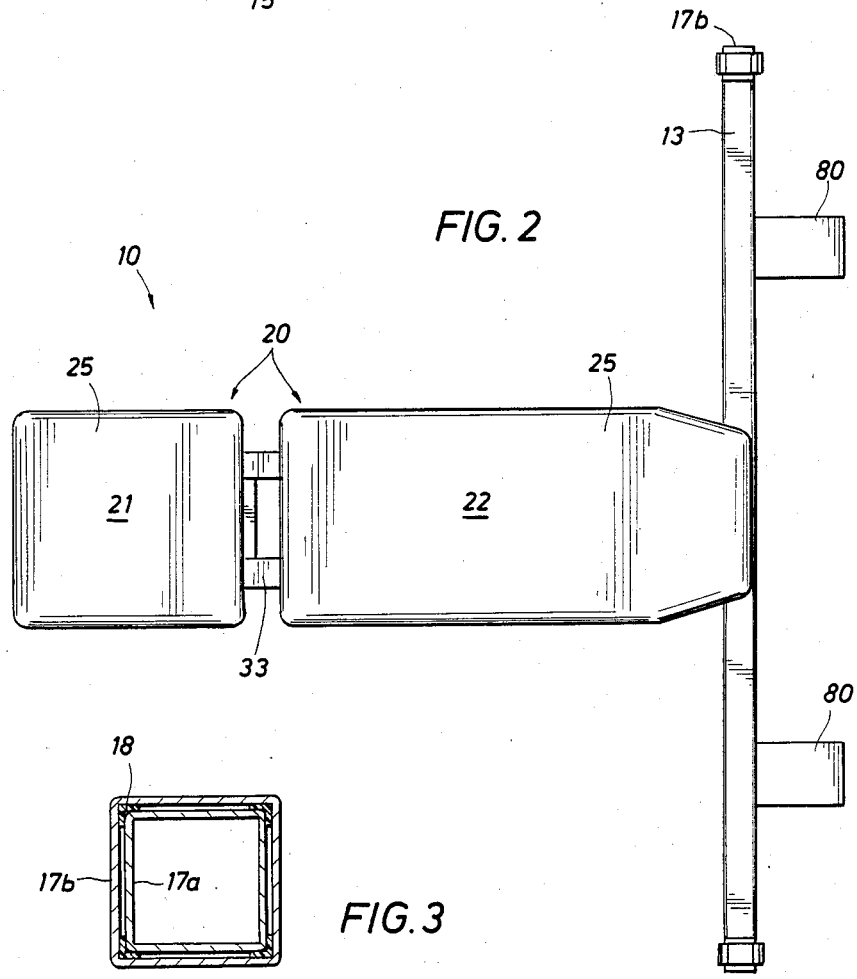
FIG. 3

FIG. 6
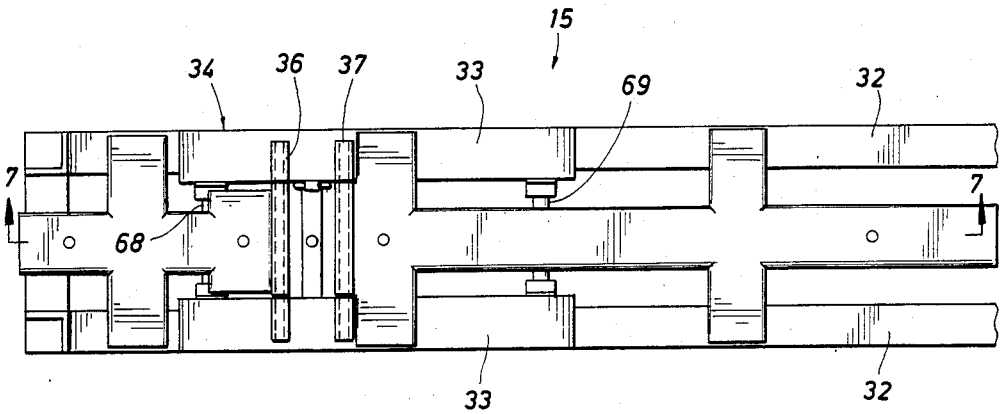
FIG. 7
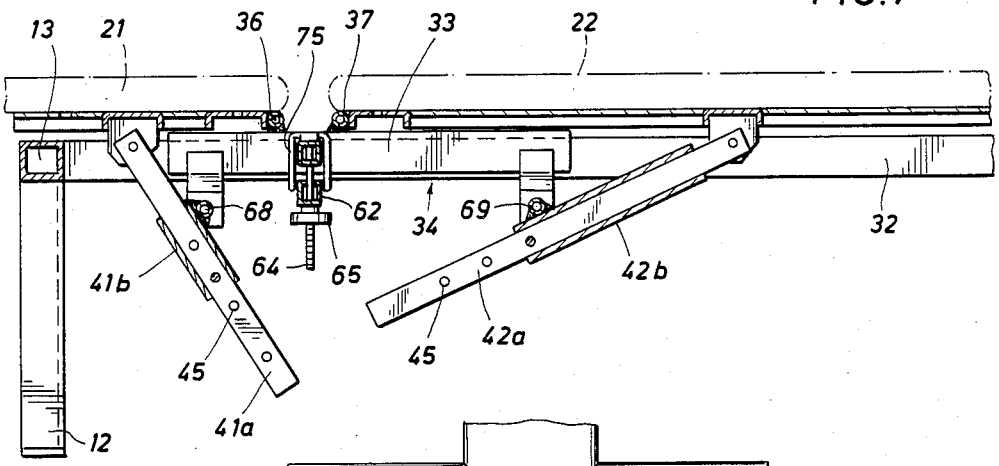
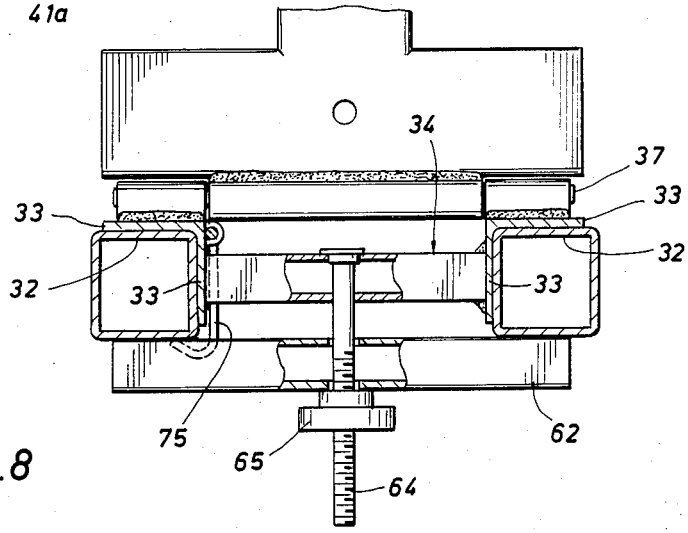
FIG. 8

FIG.10A
FIG.10B
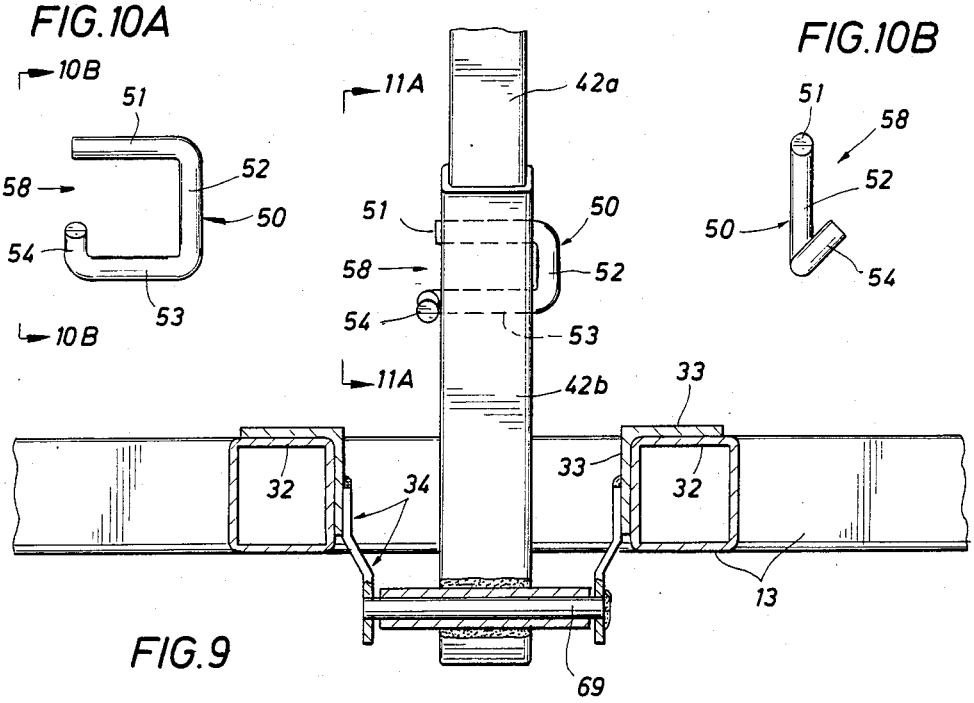
FIG.9
FIG.11A
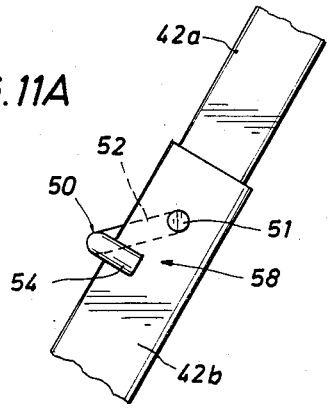
FIG.11B
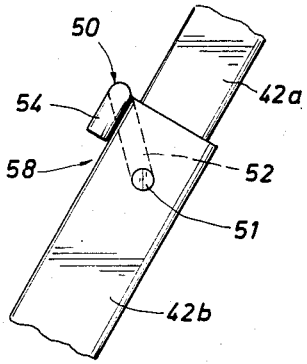
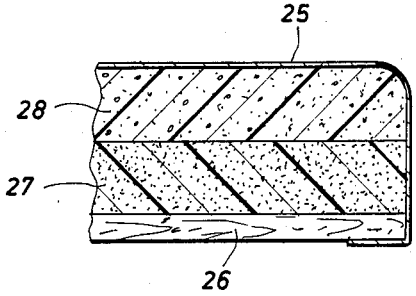
FIG.12

FIG. 13
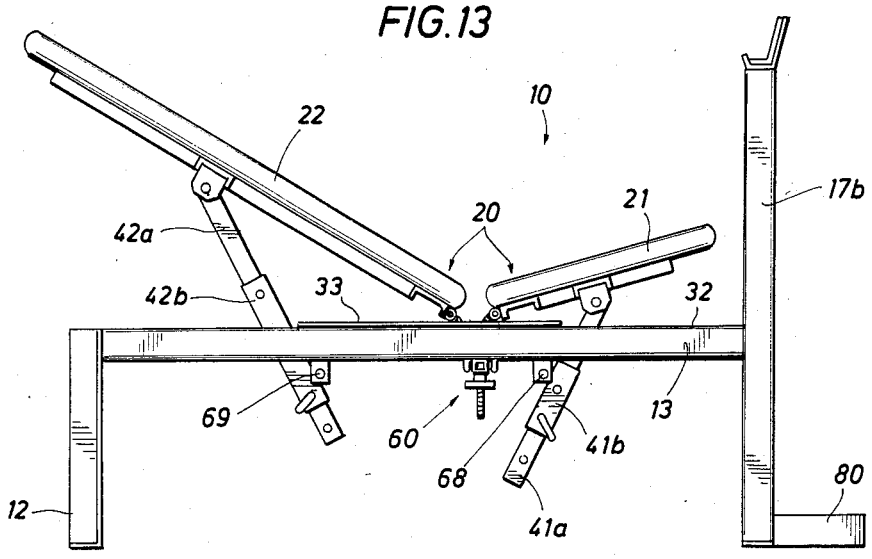
FIG. 14
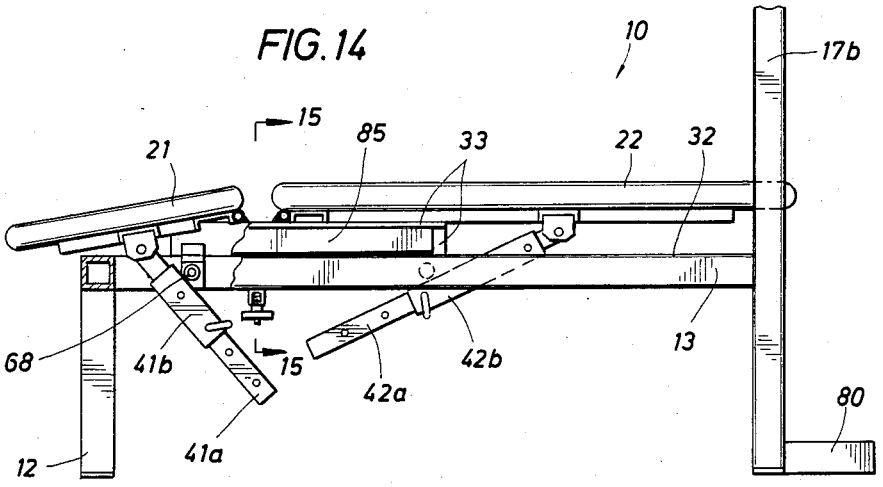
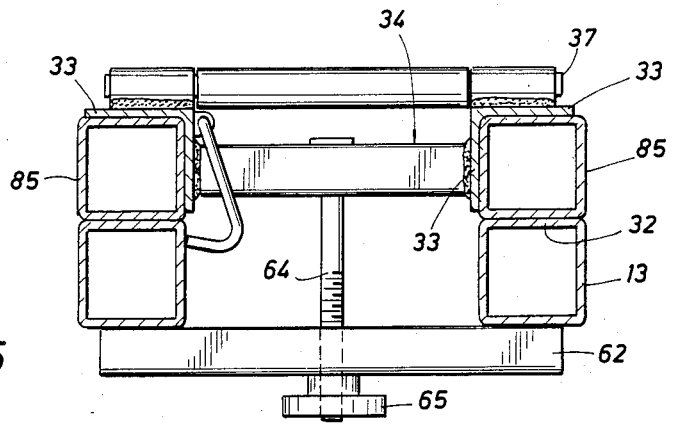
FIG. 15

HEAVY DUTY MULTI-FUNCTION EXERCISE BENCH

BACKGROUND OF THE INVENTION

The present invention relates to exercise equipment, and more particularly to an extremely versatile, heavy duty, multi-function exercise bench having the functional features which are considered necessary for significant body development through intensive weight lifting.

The modern trend in serious (e.g., competitive and commercial grade) exercise equipment is to have many different exercise units, each of which is specialized for a particular exercise. These are usually either non-adjustable, or are so inconvenient to adjust that they are adjusted only occasionally (i.e., upon set-up, or once per workout). Many of them just do not provide for quick readjustment during a particular working session or for multiple exercises at the same station. For example, a typical power bench is a simple, non-adjustable, flat bench, having a tipover bar, and designed just for flat bench presses.

Multiple-function benches are also known, of course. However, the additional functions which are available on such units are usually obtained at the expense of sturdiness and/or versatility. That is, in order to combine several functions into a single unit, prior art solutions have often been forced to accept certain user limitations. This means that the utility of such units for serious weight lifting can be greatly compromised. This can be seen from the fact that most commercial equipment, as has been discussed above, continues to be single-function—even though equipping a gym with such equipment can be far more expensive than would be necessary if suitable multi-functional equipment could be found.

A need therefore remains for a heavy duty exercise bench which, in a single, integrated unit, can function as an easily adjustable and versatile bench readily suited for many different exercises, different exercise weights, and different body sizes. Ideally, such a unit should provide easily for such exercises as incline presses, bench presses, squats, incline laterals, back military presses, stiff leg dead lifts, front squats, wrist curls, concentration curls, incline lateral presses, front shoulder presses, incline dumbbell fly presses, tricep curls, decline dumbbell presses, and so forth. The invention, in addition to being versatile and easy to use, should also be inexpensive, durable, strong yet light in weight, and reliable in use.

SUMMARY OF THE INVENTION

Briefly, the present invention meets the above needs and purposes with an extremely versatile heavy duty exercise bench which integrates into a single unit most of the functional features considered necessary for body development through weight lifting. Principally, the invention provides a manually operable, double adjustable, reversible, tiltable, and sliding seat configuration on a heavy duty frame especially designed for use therewith. The bench includes a dual foam seat construction, efficient and manually operable angled locking pins for adjusting certain bench/seat positions, efficient and manually operable clamp means for adjusting other bench/seat positions, and a combined spotter-tipover stand for improved user convenience and improved bench stability. With these and other features further explained below, the heavy duty, multi-function exercise bench of the present invention can easily accommodate the various exercises enumerated above, as well as many others.

More specifically, the heavy duty exercise bench according to the present invention consists of a base, a support frame mounted on the base, and a seat mounted and supported upon the support frame. The seat includes a base seat portion and a back seat portion. Each portion has a sandwiched inner foam construction which includes a closed cell base for firm support under high compressive loads, and an open cell top for user comfort when supporting either light or heavy loads.

The seat mounting system which mounts and supports the seat upon the support frame is manually operable. It provides for adjustably, tiltably, continuously, removably, slidingly, and reversibly securing the seat on the support frame in any of an essentially infinite number of positions on the support frame. This, in turn, provides for selectably positioning the seat on the support frame according to the size, needs, intended exercises, and desires of the person who is using the exercise bench. Thus, the lifter can position himself precisely to achieve his maximal lifting position, no matter what his physical makeup or lifting preference might be. It matters not, therefore, whether incline presses or bench presses are being done, or what the angle of the incline press is, or whether its a seated military press (in which the seat must be turned to face in the opposite direction), etc.

The seat mounting system includes pivoted support means pivotably and adjustably supporting each of the seat portions thereupon for independent manual adjustment to a plurality of predetermined, selectable angled elevations with respect to the base. In the preferred embodiment, these angles include 0° (flat), 30°, 45°, 60°, upright, and at least one additional position in between each of these. Furthermore, by raising the seat a little higher upon the support frame, the present invention provides for supporting at least one of the seat portions for adjustment to a depressed elevation (e.g., −20°, or below horizontal) to accommodate physical exercises, such as leg exercises, which are facilitated by such positions. All of this can be conveniently done according to the needs and desires of the user.

The pivoted support means includes hinges attaching each of the seat portions to the seat mount. It also includes at least two telescoping tube support member pairs, one pair for each of the seat portions. The telescoping tube member pairs support the seat portions independently of one another so that each can be separately adjusted to any of the available positions. This means that, in the preferred embodiment, the functions of the base seat portion and the back seat portion may actually be reversed, as desired. This can be very convenient, for example, when a low back is desired (which is obtained by using the regular seat portion as the back), or a long seat portion is needed (provided by using the regular back portion as the seat).

The various angles of elevation are controlled by a series of alignable holes in the telescoping tube members. The seat portions are secured in each predetermined position by aligning the corresponding set of holes in each of the telescoping members, and inserting a locking pin through the holes. A specially designed, angled locking pin is used for locking the telescoping tube members relative to one another in these various positions. The pin is particularly easy to insert and lock in place, and to release and remove. This provides for easy and rapid adjustment of the exercise bench from one exercise position to another, and from one user to the next.

The angled locking pin, in the preferred embodiment, has four legs connected one to the next in series, substantially at right angles at each such connection. The first three legs are substantially co-planar. A gap separates the first and last legs, the gap being at least as large as about half of the thickness of the tube members. The last of the legs lies at an angle with respect to the plane of the first three legs to provide for readily inserting the first leg of the locking pin through the holes while passing the tube members through the gap, and then securing the pin on the tube members by rotating the pin on the axis of the first leg thereof to bring the last leg thereof into position on the side of the tube members opposite the second leg of the locking pin. Because the last of the legs lies at an angle with respect to the plane of the first three legs, this gap can be much smaller, and the last leg correspondingly longer, than would be possible were the last leg co-planer with the first three legs.

The seat mounting system further includes complementary track members on the bottom of the seat and on a portion of the support frame facing the seat. These track members longitudinally guide the seat in an essentially infinite number of longitudinal positions along the top of the support frame. The track members include rails on the support frame and complementary flanges on the bottom of the seat for engaging the rails to support and guide the seat in the course of its longitudinal displacement therealong while preventing lateral movement of the seat with respect thereto.

The invention also includes a manually operable clamp positioned to be operable by a user while seated or while reclining upon the seat. The clamp engages the support frame on the side of the frame opposite the seat and clamps the seat against the support frame. This fastens and holds the seat in whichever of the essentially infinite number of positions, on and relative to the support frame, which has been selected by the bench user.

For convenience, the invention includes a clamp guide for releasably holding the clamp in position relative to the support frame (opposite the seat) when unclamped (for example, when released for adjusting the seat position upon the bench) for automatically positioning the clamp properly for user tightening to clamp the seat against the support frame without requiring the user to align the clamp with respect to the support frame and the seat. This is a particular convenience since the clamp can be located in a manually accessible, functional location which may be out of sight to a user who is seated or reclining upon the bench. In such a case it is not necessary to visually or tactilly align the clamp (which could be very inconvenient). The guide will ordinarily align it instead, so that the user need merely grasp and tighten it.

Another among the many features and advantages of the present invention is a spotter stand which extends from one end of the base, at the weight rest supports, for serving simultaneously as a spotter stand and a tipover stand. The tipover stand thereby increases the effective length of the base and accordingly reduces the likelihood that the exercise bench will tip over. By combining these features, the present invention adds further convenience and economy to an already highly versatile configuration.

It is therefore an object of the present invention to provide an improved, heavy duty, multi-function exercise bench; an exercise bench which is particularly well suited for serious use in performing a variety of different physical exercises, with weights, at a single exercise station; such an exercise bench which includes a base, a support frame mounted on the base, a manually operable, double adjustable, reversible, tiltable, and sliding seat configuration supported on the support frame for adjustably, tiltably, and reversibly securing the seat thereon in any of a plurality of predetermined positions, for selectably positioning the seat on the support frame according to the size, needs, intended exercises, and desires of a user thereof; in which the seat may include both a base seat portion and a back seat portion; in which the seat is pivotably mounted on the support frame, in part, by hinges which adjustably support each of the seat portions thereupon for independent manual adjustment to a plurality of predetermined, selectable angled elevations with respect to the base, according to the needs and desires of the user of the exercise bench, and such that the functions of the base seat portion and the back seat portion may be reversed as desired; which may include a spotter stand extending from one end of the base thereof for serving simultaneously as a spotter stand and a tipover stand, to thereby increase the effective length of the base and accordingly reduce the likelihood that the exercise bench will tip over; in which the seat may include a sandwiched inner foam construction having a closed cell base for firm support under high compressive loads and an open cell top for user comfort under lighter loads; in which the seat mounting means may include a pair of telescoping tube members supporting each seat portion; in which the telescoping tube member pairs may each contain at least one pair of alignable holes; in which an angled locking pin is provided for locking the telescoping tube members in position relative to one another when their alignable holes are aligned, by passing the pin simultaneously through the holes; in which the angled locking pin may have at least four legs connected one to the next in series, substantially at right angles at each such connection, the first three being substantially co-planer, and may also have a gap separating the first and last legs, the gap being at least as large as about half of the thickness of the tube members, and in which the last of the legs lies at an angle with respect to the plane of the first three legs, to provide for readily inserting the first leg of the locking pin through the holes while passing the tube members through the gap, and for then securing the pin on the tube members by rotating the pin on the axis of the first leg thereof to bring the last leg thereof into position on the side of the tube members opposite the second leg of the locking pin, whereby the gap may be much smaller and the last leg correspondingly longer than would be possible were the last leg co-planer with the first three legs; and to accomplish the above objects and purposes in a versatile, easy to use, uncomplicated, inexpensive, durable, strong, light weight, and reliable configuration, inexpensive to manufacture, and readily suited to the widest range of uses in body building and fitness training.

These and other objects and advantages of the invention will be apparent from the following description, the accompanying drawings, and the appended claims.

BRIEF DESCRIPTION OF THE DRAWINGS

FIG. 1 is a somewhat figurative side view showing an exercise bench according to the present invention;

FIG. 2 is a plan view of the bench of FIG. 1, taken on view line 2—2 thereof;

FIG. 3 is a cross-sectional view taken on line 3—3 of FIG. 1;

FIG. 6 is a plan view of the seat-supporting flange assembly in the 0° or flat position, with the seat base and seat back omitted for clarity of illustration;

FIG. 7 is a cross-sectional view taken on line 7—7 in FIG. 6;

FIG. 8 is a partially broken-away cross-sectional view taken on line 8—8 in FIG. 4;

FIG. 9 is a partially broken-away cross-sectional view taken on line 9—9 in FIG. 4;

FIG. 10A is a plan view of the locking pin according to the present invention;

FIG. 10B is a side view of the locking pin taken on view line 10B—10B in FIG. 10A;

FIG. 11A is a fragmentary side view of the telescoping tube members locked by the locking pin, and taken on view line 11A—11A in FIG. 9;

FIG. 11B is a view similar to FIG. 11A, but showing the locking pin rotated to its insertion/removal position;

FIG. 12 is a fragmentary cross-sectional view of one of the seat portions, showing the inner foam construction thereof;

FIG. 13 is a view similar to FIG. 1 showing seat assembly reversed in position upon the support frame;

FIG. 14 is a partially broken-away view showing use of shims to obtain a depressed seat elevation; and FIG. 15 is a cross-sectional view taken on line 15—15 in FIG. 14.

DESCRIPTION OF THE PREFERRED EMBODIMENTS

Figure 4:
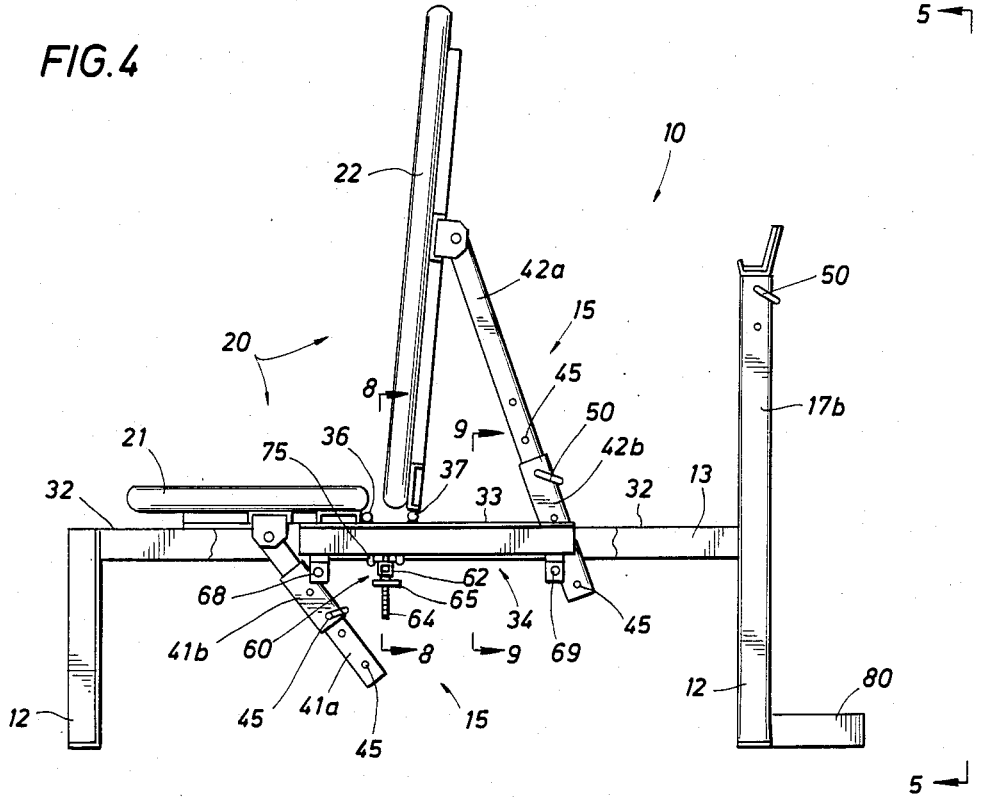
FIG. 4 is a moved view similar to FIG. 1, showing the seat portions moved to different positions.
Figure 5:
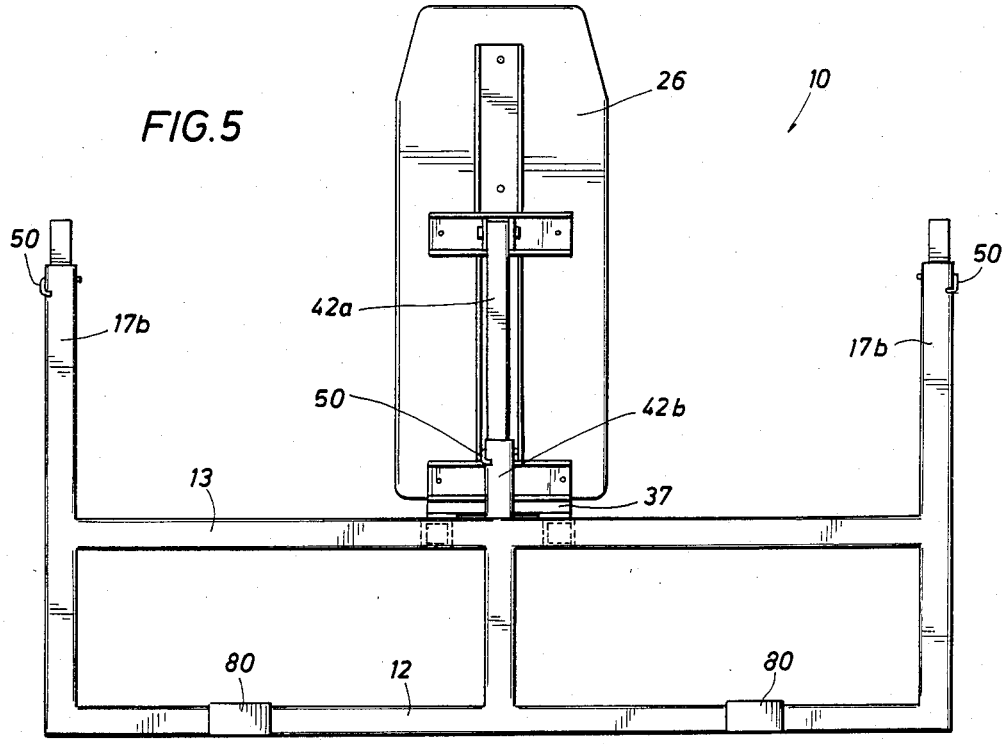
FIG. 5 is an end view of the bench in the position shown in FIG. 4, taken on view line 5—5 in FIG. 4.

With reference to the drawings, the new and improved heavy duty multi-function exercise bench 10 according to the present invention will now be described in detail. Bench 10 includes a base 12 and a support frame 13 mounted on the base. Support frame 13 supports portions of a seat mounting means 15 on the top thereof, as well as other functional elements convenient for the bench user, such as weight rest supports 17 for holding weights (not shown) before and after various exercise cycles. Supports 17 may be telescoping tube members 17*a* and 17*b*, for example, separated by angled plastic shims 18, as shown in FIG. 3.

The seat mounting means 15 supports a two part seat 20, composed of a seat base portion 21 and a seat back portion 22. Each portion has an outer cover 25, a firm back plate 26, and a two layer foam sandwich 27, 28 therebewtween. The base foam layer 27, next to plate 26, is a closed cell foam for firm support under high compressive loads. The top layer 28, next to the outer cover 25, is an open cell foam for user comfort under lighter loads.

The seat mounting means 15 supports the seat base and back 21 and 22 for adjustably, tiltably, continuously, removably, slidingly, and reversibly securing the seat 20 on the support frame. As will be shown, it supports the seat in any of an essentially infinite number of positions so that it can be positioned and adjusted on the support frame according to the size, needs, intended exercises, and desires of the user.

Specifically, the seat mounting means 15 in the preferred embodiment of the invention starts with upwardly facing rails 32 on the top of (and actually forming structural members of) the support frame 13. The rails face complementary flanges 33 on a flange assembly 34 on the bottom of the seat 20, forming part of the seat mounting means 15. The flanges 33 ride upon the rails 32 and also engage the insides of the rails to support and guide the seat 20 for longitudinal displacement along the rails 32, while preventing lateral movement of the seat. As will be seen from the drawing figures, the flanges, and therefore the entire seat 15, are free to be lifted up from the rails 32 and the support frame 13. This is particularly advantageous since it thus enables the seat to be easily reversed upon the frame 13 whenever desired. It will also be appreciated that the rails 32 and flanges 33 function together as a type of track system for guiding the seat 20 on frame 13 as described.

The seat base 21 and seat back 22 are pivotably and adjustably attached to the flange assembly 34 and supported thereon by respective hinges 36 and 37. Hinges 36 and 37 provide for manual adjustment of the seat base and back portions 21 and 22, independently of one another, to any of several angled elevations with respect to the bench base 12. The seat base and back portions 21 and 22 are then retained in these various positions by respective pairs of telescoping tubes 41*a* and 41*b*, and 42*a* and 42*b*, pivotably attached between the respective seat portions and the flange assembly 34. As will be appreciated, since the base seat portion 21 and the back seat portion 22 can be independently adjusted, their roles can be reversed if desired. That is, the back seat portion 22 can be adjusted to a horizontal position, thus becoming functionally the base, and the base seat portion 21 can be elevated, thus becoming functionally the back. Since they are of different lengths, this can be very advantageous with certain exercises.

The telescoping tubes 41*a*, 41*b*, 42*a*, and 42*b* are equipped with the alignable holes 45 along their lengths. These holes form hole pairs which, when aligned, define various seat base and seat back elevations. In the preferred embodiment, these have been selected to provide elevational angles of 0° (flat), 30°, 45°, 60°, 80°–85° (upright), as well as an additional position in between each of them. The seat positions which are selected are then retained by locking the tube pairs 41*a* and 41*b*, and 42*a* and 42*b*, in position relative to one another with an angled locking pin 50. Pin 50 has four legs 51, 52, 53, and 54. Leg 51 is simultaneously passed through the holes in the selected tube pair (FIGS. 9–11) to lock the tube pair in position.

Pin 50 is a significant improvement over prior art locking pins, and adds to the utility and convenience of the present invention. In the preferred embodiment, legs 51, 52, and 53 of pin 50 are connected one to the next in series, at right angles to each other, and all lying in a common plane. The fourth leg 54 is connected to leg 53 at a right angle, but it also lies at an angle of about 45° with respect to the plane of legs 51, 52, and 53. Leg 54 is also shorter than the other legs, so that it defines an opening or gap 58 between itself and leg 51. This facilitates insertion of leg 51 into the holes 45, since the tube members 41*a* and 41*b*, or 42*a* and 42*b*, can be passed through gap 58 as leg 51 is inserted into and through holes 45 (FIG. 11B). By angling leg 54 with respect to the plane of the other three legs 51–53, the gap may be smaller and leg 54 longer than would be possible were all four legs co-planer. Yet the locking pin 50 can still be secured in place by rotating it on the axis of leg 51 to bring leg 54 into position on the side of the tube members opposite leg 52 (FIG. 11A). This is the same as would be expected with a co-planer locking pin, but as suggested, a much larger gap and much more rotation would be required, with less engagement of the last leg behind the tube members, than obtains with the present invention.

As will be appreciated thus far, a totally manually adjustable exercise bench has been described. This important feature is continued with the longitudinal adjustment, and the reversability feature, of the present invention. In particular, as was described above, the seat 20 can be entirely lifted off the rails 32 for easy reversal. It can also be positioned in any position therealong. Of course, it would usually be undesirable to do exercises on the seat without having it secured in the selected position to the support frame 13. This is accomplished with a manually operable clamp 60.

Clamp 60, which is located beneath seat 20, consists of a cross bar 62 mounted on a screw 64 which is threaded into the flange assembly 34 under seat 20. Screw 64 is turned by a hand wheel or handle 65, located underneath seat 20 where it can easily be reached by the bench user. To tighten and clamp the seat in place, then, cross bar 62 is positioned underneath rails 32, opposite seat 20, and the handle 65 is turned to tighten screw 64 and cross bar 62 against the rails 32. This clamps seat 20 against the support frame 13 to hold it in position. Note that the hinge 68 between the flange assembly 34 and the telescoping tubes 41, and the hinge 69 between the flange assembly 34 and the telescoping tubes 42, are each located below the rails 32. This keeps the tubes 41 and 42 at an angle even when the seat base 21 and seat back 22 are horizontal. This in turn assures that there will be clearance at all times for manual access to handle 65. Note also that hinges 68 and 69 are narrower than the spacing between rails 32, thus facilitating lifting and removal of the seat assembly 20 when it is being reversed.

It will also be apparent that cross bar 62 can be turned so that it aligns with rails 62 when the seat is being lifted therefrom. Of course, when it is loose (unclamped) it can also turn when the user slides the seat, and when the user tries to tighten it by turning handle 65. This can be inconvenient if the user is seated or lying upon seat 20. The present invention solves this problem by including a clamp guide 75 on the flange assembly 34 which clips removably onto the cross bar 62 to keep it aligned transversely beneath rails 32 without requiring the user to align it with respect to the support frame 13 and the seat 20. Then, when the seat is to be removed from the support frame 13, the clamp guide 75 is unclipped from the cross bar 62 so that it can be turned as needed.

For certain exercises, it is advantageous to be able to lower the seat base 21 (or the seat back portion 22) below horizontal. Such a depressed elevation, for example, can help accommodate various leg exercises. The present invention solves this need by inserting shims 85 between the rails 32 and the flanges 33 (FIGS. 14–15). The shims, which may be square tubing sections the same as used for the support frame 13 and rails 32, raise the entire seat assembly 20 so that it can clear the ends of the support frame when adjusted to such a depressed elevation.

Weight lifters are frequently assisted by a spotter, who stands at the weight rest supports 17 to help the lifter. A spotter stand 80 is therefore provided for the spotter to stand upon. The spotter stand 80 also serves as a tipover stand to extend or increase the effective length of the bench base 12 to reduce the likelihood that the bench might tip over when large amounts of weight are thrown onto the weight rest supports 17.

As may be seen, therefore, the present invention provides numerous advantages. Principally, it provides an extremely versatile, heavy duty, multi-function exercise bench 10 having the functional features which are considered necessary for significant body development through intensive weight lifting. The invention includes a manually operable, double adjustable, reversible, tiltable, and sliding seat configuration on a heavy duty frame which is especially designed for use therewith. The invention also provides a dual foam seat construction, efficient and manually operable angled locking pins and manually operable clamp means for bench/seat position adjustments, and a combined spotter-tipover stand for improved user convenience and improved bench stability. The invention also readily lends itself to convenient variations upon the preferred embodiments described above. For example, fixed longitudinal positions may be provided, such as with locking pins engaged through matching holes. Other clamping means may be used as well. Also, a suitable built-in riser could be used in place of the shims 85. These advantages and improvements are provided in a versatile, easy to use, uncomplicated, inexpensive, durable, strong, light weight, and reliable configuration, inexpensive to manufacture, and readily suited to the widest range of uses in body building and fitness training.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A versatile exercise bench particularly well suited for performing a variety of different physical exercises with weights, comprising:

(a) a base, (b) a longitudinal support frame mounted on said base, (c) a seat having at least a base portion and a back portion, and (d) manually operable seat mounting means for reversibly securing said seat on said support frame so that the position of the base portion and back portion can be reversed, said seat means mounting means including a means of slidably adjusting the longitudinal position of the seat on the support frame, and said seat mounting means further including a means for pivotably supporting each seat portion for independent adjustment to a plurality of angled elevations, for selectably positioning said seat on said support frame according to the size, needs, intended exercises, and desires of a user thereof.

2. The exercise bench of claim 1 wherein said seat mounting means further comprises means for removably attaching said seat to said support frame to provide more readily for reversing said seat thereon, and for attaching said seat to said support frame to provide for longitudinal adjustment of said seat to a plurality of positions relative to said support frame.

3. The exercise bench of claim 2 wherein said seat mounting means further comprises complementary track means on the bottom of said seat mounting means and on a portion of said support frame facing said seat for longitudinally guiding said seat in an essentially infinite number of positions along said support frame.

4. The exercise bench of claim 3 wherein said track means further comprises rail means on said support frame, and complementary flange means on the bottom of said seat mounting means for engaging said rail means to support and guide said seat for longitudinal displacement therealong while essentially preventing lateral movement of said seat with respect thereto.

5. The exercise bench of claim 3 wherein said seat mounting means further comprises clamp means for fastening and holding said seat mounting means in any of said essentially infinite number of positions on said support frame.

6. The exercise bench of claim 5 wherein said clamp means further comprises manually operable clamp means positionable for engaging and clamping said seat mounting means against said support frame.

7. The exercise bench of claim 6 wherein said manually operable clamp means is positioned to be operable by a user while seated upon said seat and also while reclining upon said seat.

8. The exercise bench of claim 7 further comprising clamp guide means for releasbly holding said clamp means in position relative to said support frame opposite said seat when unclamped, such as for adjusting said seat upon said bench, for automatically positioning said clamp means properly for user tightening to clamp said seat mounting means against said support frame without requiring the user to align said clamp means with respect to said support frame and said seat.

9. The exercise bench of claim 1 wherein said pivoted support means further comprises hinge means attaching each of said seat portions to said seat mounting means, and support members for each of said seat portions for supporting said seat portions independently of one another in a plurality of user selectable predetermined angled positions with respect to said base, such that the functions of said base seat portion and said back seat portion may be reversed as desired.

10. The exercise bench of claim 9 wherein said seat mounting means further comprises means mounting at least one of said seat portions for adjustment to a depressed elevation, below horizontal, to accommodate physical exercises which are facilitated by such a position.

11. The exercise bench of claim 1 further comprising a spotter stand extending from one end of said base thereof for serving simultaneously as a spotter stand and a tipover stand, the tipover stand thereby increasing the effective length of said base and accordingly reducing the likelihood that said exercise bench will tip over.

12. The exercise bench of claim 1 wherein said seat further comprises a sandwiched inner foam construction having a closed cell base for firm support under high compressive loads, and an open cell top for user comfort under lighter loads.

13. The exercise bench of claim 1 wherein said seat mounting means further comprises:

(a) at least two telescoping tube members supporting at least a portion of said seat on said support frame, (b) means providing at least one pair of alignable holes in said telescoping tube members, and (c) an angled locking pin for locking said telescoping tube members in position relative to one another when said holes are aligned by passing simultaneously through said holes, said angled locking pin having at least four legs connected one to the next in series, substantially at right angles at each such connection, the first three being substantially co-planer, means defining a gap separating the first and last legs, said gap being at least as large as substantially half the thickness of said tube members, and the last of said legs lying at an angle with respect to the plane of said first three legs, to provide for readily inserting said first leg of said locking pin through said holes while passing said tube members through said gap, and for then securing said pin on said tube members by rotating said pin on the axis of the first leg thereof to bring said last leg thereof into position on the side of said tube members opposite the second leg of said locking pin, whereby said gap may be much smaller and said last leg correspondingly longer than would be possible were said last leg co-planer with said first three legs.

14. A locking pin for locking two telescoping tube members having at least one pair of alignable holes therein for locking the telescoping tube members in position relative to one another when the holes are aligned and the pin is passed simultaneously through the holes, comprising:

(a) at least four legs connected one to the next in series, substantially at right angles at each such connection, and the first three being substantially co-planer, (b) means defining a gap separating the first and last legs, said gap being at least as large as substantially half the thickness of the tube members, and (c) the last of said legs lying at an angle with respect to the plane of said first three legs, to provide, when the holes in the tube members are aligned, for readily inserting said first leg of said locking pin through the holes while passing the tube members through said gap, and for then securing said pin on the tube members by rotating said pin on the axis of the first leg thereof to bring said last leg thereof into position on the side of the tube members opposite the second leg of said locking pin, whereby said gap may be much smaller and said last leg correspondingly longer than would be possible were said last leg co-planer with said first three legs.

15. A versatile exercise bench particularly well suited for performing a variety of different physical exercises with weights, comprising:

(a) a base, (b) a support frame mounted on said base, (c) a seat, including a base seat portion and a back seat portion, each portion having a sandwiched inner foam construction which includes a closed cell base for firm support under high compressive loads, and an open cell top for user comfort under lighter loads, (d) manually operable seat mounting means for adjustably, tiltably, continuously, removably, slidingly, and reversibly securing said seat on said support frame in any of an essentially infinite number of positions on said support frame, for selectably positioning said seat on said support frame according to the size, needs, intended exercises, and desires of a user thereof, (e) said seat mounting means including pivoted support means pivotably and adjustably supporting each of said seat portions thereupon for independent manual adjustment to a plurality of predetermined, selectable angled elevations with respect to said base, and for supporting at least one of said seat portions for adjustment to a depressed elevation, below horizontal, to accommodate physical exercises which are facilitated by such positions, according to the needs and desires of the user of said exercise bench, (f) said pivoted support means including hinge means attaching each of said seat portions to said seat mounting means, and at least two telescoping tube support members for each of said seat portions for supporting said seat portions independently of one another in each of said positions, such that the functions of said base seat portion and said back seat portion may be reversed as desired, (g) means providing at least one pair of alignable holes in said telescoping tube members, (h) an angled locking pin for locking said telescoping tube members in position relative to one another when said holes are aligned by passing simultaneously through said holes, said angled locking pin having at least four legs connected one to the next in series, substantially at right angles at each such connection, the first three being substantially coplaner, means defining a gap separating the first and last legs, said gap being at least as large as substantially half the thickness of said tube members, and the last of said legs lying at an angle with respect to the plane of said first three legs, to provide for readily inserting said first leg of said locking pin through said holes while passing said tube members through said gap, and then securing said pin on said tube members by rotating said pin on the axis of the first leg thereof to bring said last leg thereof into position on the side of said tube members opposite the second leg of said locking pin, whereby said gap may be much smaller and said last leg correspondingly longer than would be possible were said last leg co-planer with said first three legs, (i) said seat mounting means further including complementary track means on the bottom of said seat and on the top of said support frame facing said seat for longitudinally guiding said seat in an essentially infinite number of positions along the top of said support frame, said track means including rail means on said support frame, and complementary flange means on the bottom of said seat for engaging said rail means to support and guide said seat for longitudinal displacement therealong while essentially preventing lateral movement of said seat with respect thereto, (j) manually operable clamp means positioned to be operable by a user while seated upon said seat and also while reclining upon said seat, for engaging and clamping said seat against said support frame for fastening and holding said seat in any of said essentially infinite number of positions on said support frame, (k) clamp guide means for releasably holding said clamp means in position relative to said support frame opposite said seat when unclamped, such as for adjusting said seat upon said bench, for automatically positioning said clamp means properly for user tightening to clamp said seat against said support frame without requiring the user to align said clamp means with respect to said support frame and said seat, and (l) a spotter stand extending from one end of said base for serving simultaneously as a spotter stand and a tipover stand, the tipover stand thereby increasing the effective length of said base and accordingly reducing the likelihood that said exercise bench will tip over.

* * * * *